US009016254B2

(12) United States Patent
Tanaka

(10) Patent No.: US 9,016,254 B2
(45) Date of Patent: Apr. 28, 2015

(54) INTAKE CONTROL DEVICE

(71) Applicant: Suzuki Motor Corporation, Hamamatsu-shi, Shizuoka (JP)

(72) Inventor: Koichi Tanaka, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 127 days.

(21) Appl. No.: 13/713,360

(22) Filed: Dec. 13, 2012

(65) Prior Publication Data

US 2013/0146012 A1 Jun. 13, 2013

(30) Foreign Application Priority Data

Dec. 13, 2011 (JP) ..... 2011-272335
Dec. 15, 2011 (JP) ..... 2011-274456

(51) Int. Cl.

| | |
|---|---|
| ***F02M 35/10*** | (2006.01) |
| ***F02M 35/04*** | (2006.01) |
| ***F02D 9/10*** | (2006.01) |
| ***F02D 11/02*** | (2006.01) |
| ***F02D 11/10*** | (2006.01) |
| ***F02M 35/16*** | (2006.01) |

(52) U.S. Cl.

CPC ..... *F02M 35/10373* (2013.01); *F02M 35/044* (2013.01); *F02D 9/105* (2013.01); *F02D 9/1095* (2013.01); *F02D 11/02* (2013.01); *F02D 11/106* (2013.01); *F02M 35/162* (2013.01); *F02M 35/10386* (2013.01); *F02M 35/042* (2013.01)

(58) Field of Classification Search

CPC ..... F02M 35/042; F02M 35/044; F02M 35/10373; F02M 35/10386; F02M 35/162; F02D 11/106; F02D 11/02; F02D 9/1095; F02D 9/105

USPC ..... 123/184.53

See application file for complete search history.

(56) References Cited

U.S. PATENT DOCUMENTS

| | | | | |
|---|---|---|---|---|
| 7,066,135 | B2 * | 6/2006 | Ishikawa et al. | 123/198 E |
| 7,311,082 | B2 | 12/2007 | Yokoi | |
| 7,556,008 | B2 * | 7/2009 | Watanabe et al. | 123/184.21 |
| 2002/0050268 | A1 * | 5/2002 | Deguchi | 123/336 |
| 2005/0211220 | A1 * | 9/2005 | Matsuda | 123/336 |
| 2006/0243246 | A1 | 11/2006 | Yokoi | |
| 2007/0175430 | A1 | 8/2007 | Yokoi | |

FOREIGN PATENT DOCUMENTS

| | | |
|---|---|---|
| EP | 1808595 A2 | 7/2007 |
| JP | 2006336638 | 12/2006 |

OTHER PUBLICATIONS

Extended European Search Report, dated Aug. 2, 2013, which issued during the prosecution of European Patent Application No. 12196662.6.

* cited by examiner

*Primary Examiner* — Lindsay Low
*Assistant Examiner* — Kevin Lathers
(74) *Attorney, Agent, or Firm* — Troutman Sanders LLP

(57) ABSTRACT

An intake control device includes: an air cleaner disposed above an engine; a pair of right and left intake ducts projecting toward a front of a vehicle body from the air cleaner to take an outside air in the air cleaner; and a sensor unit coupled to a throttle cable extended from a throttle grip, and detecting an operation amount of accelerator, in which the sensor unit is disposed between the pair of right and left intake ducts at a position above the engine and below the air cleaner.

18 Claims, 24 Drawing Sheets

INTAKE CONTROL DEVICE

CROSS-REFERENCE TO RELATED APPLICATIONS

This application is based upon and claims the benefit of priority of the prior Japanese Patent Application No. 2011-272335, filed on Dec. 13, 2011, and the prior Japanese Patent Application No. 2011-274456, filed on Dec. 15, 2011, the entire contents of which are incorporated herein by reference.

BACKGROUND OF THE INVENTION

1. Field of the Invention

The present invention relates to an intake control device of a motorcycle, and particularly relates to an intake control device that electronically controls an intake amount of engine.

2. Description of the Related Art

Conventionally, as an intake control device, there has been known one in which an accelerator position sensor is disposed on a throttle body (refer to Patent Document 1, for example). In the throttle body described in Patent Document 1, a valve stem rotatably supporting a throttle valve is provided, and there is provided a sensor unit adjacent to the valve stem. In the sensor unit, there are provided a throttle pulley coupled to an accelerator operating part via a throttle cable, and an accelerator position sensor that detects an operation amount of the accelerator operating part.

In the sensor unit, the throttle pulley is rotated in conjunction with the operation of the accelerator operating part, and the rotation of the throttle pulley is detected, as the operation amount of the accelerator operating part, by the accelerator position sensor. The operation amount of the accelerator operating part is output to an ECU (Electronic Control Unit) from the accelerator position sensor, and an opening degree of the throttle valve is calculated in the ECU. By the control of the ECU, an electric motor coupled to the valve stem is driven, and the opening degree of the throttle valve is adjusted, resulting in that an intake amount of engine is electrically controlled.

[Patent Document 1] Japanese Laid-open Patent Publication No. 2006-336638

However, in the intake control device described in Patent Document 1, the throttle body was provided on a cylinder head, and the sensor unit was disposed in an atmosphere of high temperature in the vicinity of the cylinder head. For this reason, there was a problem that a detection error becomes large due to an influence of temperature characteristics of the accelerator position sensor. Further, since there was a need to extend the cable to the throttle body (throttle pulley) of the engine from the accelerator operating part, the throttle cable became long, resulting in that there was a chance of adversely affecting an operationality of the accelerator operating part.

SUMMARY OF THE INVENTION

The present invention has been made in view of such points, and an object thereof is to provide an intake control device capable of improving an operationality of an accelerator operating part and enhancing a detection accuracy of an accelerator position sensor.

An intake control device of the present invention is characterized in that, in an intake control device controlling an intake amount of engine based on opening/closing of throttle valves in correspondence with an operation amount of an accelerator operating part, there are provided: an air cleaner disposed above the engine and connected to the engine via the throttle valves; a pair of right and left intake ducts projecting toward a front of a vehicle body from the air cleaner to take an outside air in the air cleaner; and a sensor unit coupled to a throttle cable extended from the accelerator operating part, and detecting the operation amount of the accelerator operating part, in which the sensor unit is disposed to overlap with at least a part of the pair of right and left intake ducts in a side view, at a position above the engine and below the air cleaner.

It is possible to adopt a structure in which, on a bottom part of the air cleaner, a recessed part is formed, between the pair of right and left intake ducts, to bulge in the air cleaner, and at least a part of the sensor unit is housed in the recessed part.

It is possible to adopt a structure in which a plurality of outside air intake ports through which an air is taken in the engine are provided in the air cleaner, and the recessed part is disposed to overlap with a width center line passing through a center of width in a vehicle width direction of the plurality of outside air intake ports and extending in front and rear directions of the vehicle body, in a top view.

It is possible to adopt a structure in which a center position in the vehicle width direction of the recessed part is positioned on the width center line.

It is possible to adopt a structure in which the recessed part has a width-narrowed portion in which a width becomes narrow from an upstream side toward a downstream side of an intake flow direction in the air cleaner.

It is possible to adopt a structure in which a coupler extending rearward from the sensor unit is disposed on the width-narrowed portion of the recessed part.

It is possible to adopt a structure in which a center position in the vehicle width direction of the width-narrowed portion of the recessed part is positioned on the width center line in the vehicle width direction.

It is possible to adopt a structure in which the sensor unit is disposed to overlap with a vehicle body center line extending in front and rear directions of the vehicle body, in a top view.

It is possible to adopt a structure in which a center position in a vehicle width direction of the sensor unit is positioned on the vehicle body center line.

It is possible to adopt a structure in which the sensor unit has a throttle pulley that rotates in conjunction with the operation of the accelerator operating part via the throttle cable, and an accelerator position sensor that detects the operation amount of the accelerator operating part in correspondence with a rotation amount of the throttle pulley, and the throttle pulley is disposed disproportionately on a side of the accelerator operating part in a vehicle width direction with respect to a vehicle body center line extending in front and rear directions of the vehicle body.

It is possible to adopt a structure in which the sensor unit is attached to the air cleaner.

The present invention is characterized in that, in an intake control device controlling an intake amount of engine based on opening/closing of throttle valves in correspondence with an operation amount of an accelerator operating part, there are provided: an air cleaner disposed above the engine and connected to the engine via the throttle valves; a pair of right and left intake ducts projecting toward a front of a vehicle body from the air cleaner to take an outside air in the air cleaner; and a sensor unit coupled to a throttle cable extended from the accelerator operating part, and detecting the operation amount of the accelerator operating part, in which the sensor unit is disposed, in the air cleaner, between openings of the pair of right and left intake ducts formed in the air cleaner.

It is possible to adopt a structure in which a filter is provided in the air cleaner to partition the inside of the air cleaner into a dirty side on an upstream side of an intake flow direction and a clean side on a downstream side of the intake flow direction, and the sensor unit is disposed on the dirty side.

It is possible to adopt a structure in which the sensor unit is disposed to overlap with a vehicle body center line extending in front and rear directions of the vehicle body, in a top view.

It is possible to adopt a structure in which a plurality of outside air intake ports through which an outside air is taken in the engine are provided in the air cleaner, and the sensor unit is disposed to overlap with a width center line passing through a center of width in a vehicle width direction of the plurality of outside air intake ports and extending in front and rear directions of the vehicle body, in a top view.

It is possible to adopt a structure in which the sensor unit has a throttle pulley that rotates in conjunction with the operation of the accelerator operating part via the throttle cable, and an accelerator position sensor that detects the operation amount of the accelerator operating part in correspondence with a rotation amount of the throttle pulley, and the throttle cable is extended forward from the throttle pulley.

It is possible to adopt a structure in which, in the air cleaner, a pair of flow-regulating plates regulating an intake flow in the air cleaner are provided between the sensor unit and openings of the pair of right and left intake ducts.

It is possible to adopt a structure in which the sensor unit is disposed at a position higher than a lowest surface in the air cleaner.

DETAILED DESCRIPTION OF THE PREFERRED EMBODIMENTS

Hereinafter, respective embodiments of the present invention will be described in detail while referring to the accompanying drawings. Note that in the description hereinbelow, explanation will be made on an example in which an intake control device according to each embodiment of the present invention is applied to an on-road-type motorcycle. However, the present invention is not limited to this, and a modification can be made appropriately. For example, the intake control device according to each embodiment of the present invention can also be applied to a motorcycle of another type, and another transportation machine that uses an electronically-controlled throttle body.

Figure 1:
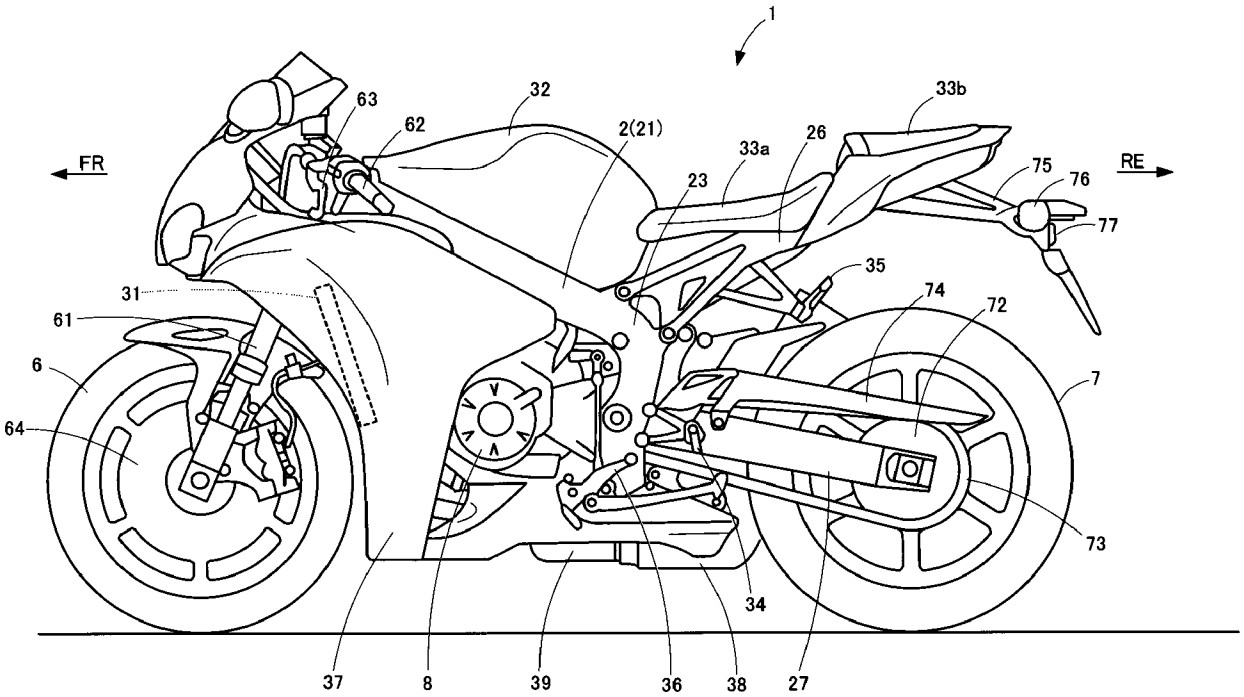
FIG. 1 is a left side view of a motorcycle according to the present embodiment.
Figure 2:
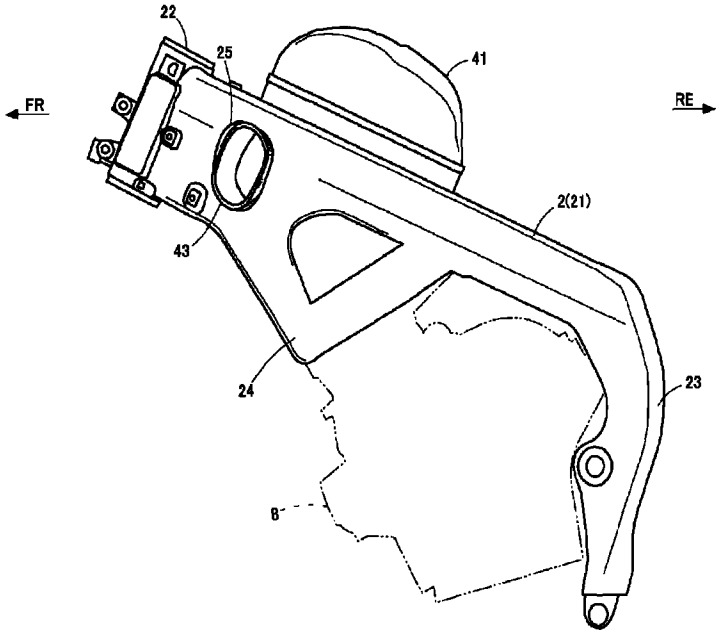
FIG. 2 is a left side view of a part in the periphery of an air cleaner according to the present embodiment.
Figure 3:
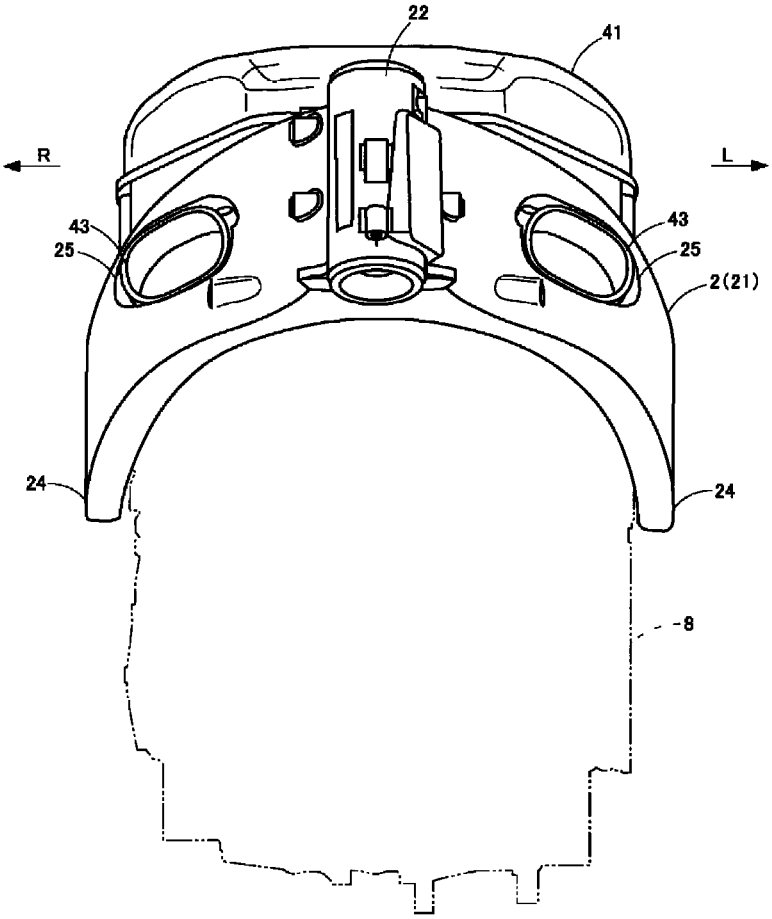
FIG. 3 is a front view of a part in the periphery of the air cleaner according to the present embodiment.
Figure 4:
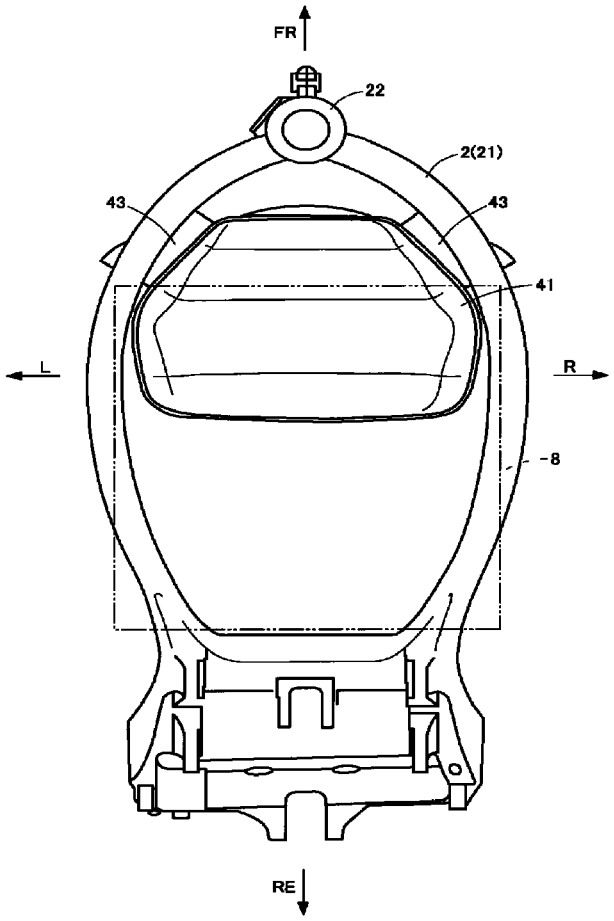
FIG. 4 is a top view of a part in the periphery of the air cleaner according to the present embodiment.

While referring to FIG. 1 to FIG. 4, a schematic structure of the entire motorcycle 1 to which an intake control device 10 according to each embodiment of the present invention is applied, will be described. FIG. 1 is a left side view of the motorcycle 1 to which the intake control device 10 according to each embodiment of the present invention is applied. FIG. 2 is a left side view of a part in the periphery of an air cleaner 41 according to each embodiment. FIG. 3 is a front view of a part in the periphery of the air cleaner 41 according to each embodiment. FIG. 4 is a top view of a part in the periphery of the air cleaner 41 according to each embodiment. Note that in FIG. 1 to FIG. 4, a front of a vehicle body, a rear of the vehicle body, a left side of the vehicle body, and a right side of the vehicle body are indicated by an arrow mark FR, an arrow mark RE, L, and R, respectively. Further, in FIG. 2 to FIG. 4, an engine unit 8 is illustrated by a two-dot chain line, for the convenience of explanation.

As illustrated in FIG. 1 to FIG. 4, the motorcycle 1 includes a vehicle body frame 2 made of steel or aluminum alloy. Further, on the vehicle body frame 2, respective parts including the engine unit 8, electrical parts and the like are mounted. A main frame 21 of the vehicle body frame 2 branches off right and left toward the rear direction from a head pipe 22 positioned at a front end portion thereof, and each main frame extends diagonally downward. From a rear end side of each of the main frames 21, a swing arm bracket 23 extends in a downward direction. Further, from a front end side of each of the main frames 21, an engine mounting bracket 24 extends in a substantially downward direction. A lower end portion of the engine mounting bracket 24 is connected to a substantially middle portion of the main frame 21.

At a position below the main frames 21, the engine unit 8 is mounted so as to be suspended by the engine mounting brackets 24 and the swing arm brackets 23. At a position in front of the engine unit 8, a radiator 31 is disposed. At a position between the radiator 31 and the engine unit 8, a radiator heat guard (not illustrated) is interposed. At a position above the engine unit 8, an air cleaner 41 is disposed to be sandwiched by the right and left main frames 21. From the air cleaner 41, a pair of right and left intake ducts 43 project toward a front of a vehicle body. Further, the intake ducts 43 are inserted into openings 25 formed on a front end side of the vehicle body frame 2.

At a position above the air cleaner 41, a fuel tank 32 is disposed. At a position behind the fuel tank 32, a rider seat 33*a* and a pillion seat 33*b* are continuously provided. The rider seat 33*a* and the pillion seat 33*b* are supported by a pair of right and left seat rails 26 connected to rear portions of the main frames 21. At positions below the rider seat 33*a* and the pillion seat 33*b*, there are provided footrests 34 and 35 by corresponding to the respective seats. At a position in front of the footrest 34 for a rider on the left side of the vehicle body, a shifting change pedal 36 is provided, and at a position in front of the footrest 34 for the rider on the right side of the vehicle body, a brake pedal (not illustrated) for a rear wheel 7 is provided.

On the front end portion of the vehicle body frame 2, front forks 61 are rotatably supported by the head pipe 22 via a not-illustrated steering shaft. A handle bar (not illustrated) is provided at an upper end portion of the steering shaft. To both end portions of the handle bar, grips 62 are attached. The grip 62 on the right side of the vehicle body is a throttle grip as an accelerator operating part. At a position on the left and in front of the handle bar, a clutch lever 63 is disposed. At a position on the right and in front of the handle bar, a brake lever (not illustrated) for a front wheel 6 is disposed. The front wheel 6 is rotatably supported by lower portions of the front forks 61. The front wheel 6 is provided with a brake disk 64.

To the swing arm brackets 23 of the vehicle body frame 2, swing arms 27 are coupled in a vertically swingable manner. At a position between the vehicle body frame 2 and each swing arm 27, a suspension (not illustrated) is attached. The rear wheel 7 is rotatably supported by rear portions of the swing arms 27. On the left side of the rear wheel 7, a driven sprocket 72 is provided. It is structured such that a motive power of the engine unit 8 is transmitted to the rear wheel by a drive chain 73. On the right side of the rear wheel 7, a brake disk (not illustrated) for the rear wheel 7 is provided.

A portion above the drive chain 73 is covered by a chain cover 74. A portion above the rear wheel 7 is covered by a rear fender 75 disposed behind the pillion seat 33*b*. On the rear fender 75, a pair of right and left rear turn signals 76 are disposed, and a brake lamp 77 is disposed behind the rear turn signals 76. Further, to the vehicle body frame 2 and the like, a cowl 37 is provided as an exterior of the vehicle body. At a position between the cowl 37 and the vehicle body frame 2, there is formed a gap from which an outside air is taken into the engine unit 8 from the front of the vehicle body.

The engine unit 8 has, for example, a parallel four-cylinder engine being an internal combustion engine, and a transmission. Further, the engine unit 8 is suspended to the main frames 21 in a state where a center line of combustion chamber of the engine is tilted forward. In the engine unit 8, an air is taken via the intake ducts 43 and the air cleaner 41. Further, the air and a fuel are mixed in a fuel injection device to be supplied to the combustion chamber. An exhaust gas after the combustion in the combustion chamber passes through an exhaust pipe 39 extended downward from the engine unit 8, and is exhausted from a muffler 38. In this case, an intake amount into the engine unit 8 is controlled by the intake control device 10 mounted on the motorcycle 1.

Next, a detailed structure of the intake control device 10 according to the first embodiment will be described with reference to FIG. 5 to FIG. 11. The intake control device 10 according to the first embodiment includes the air cleaner 41, the pair of right and left intake ducts 43 projecting toward the front of the vehicle body from the air cleaner 41, and a sensor unit 45 detecting an operation amount of the throttle grip as the accelerator operating part.

Figure 5:
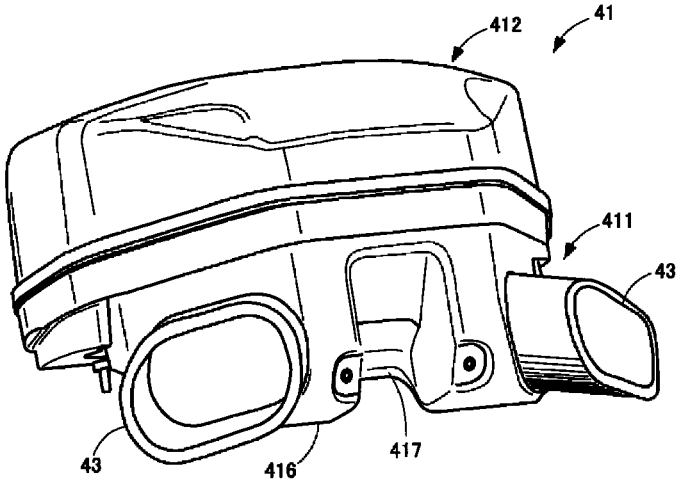
FIG. 5 is a perspective view of an air cleaner according to a first embodiment.
Figure 6:
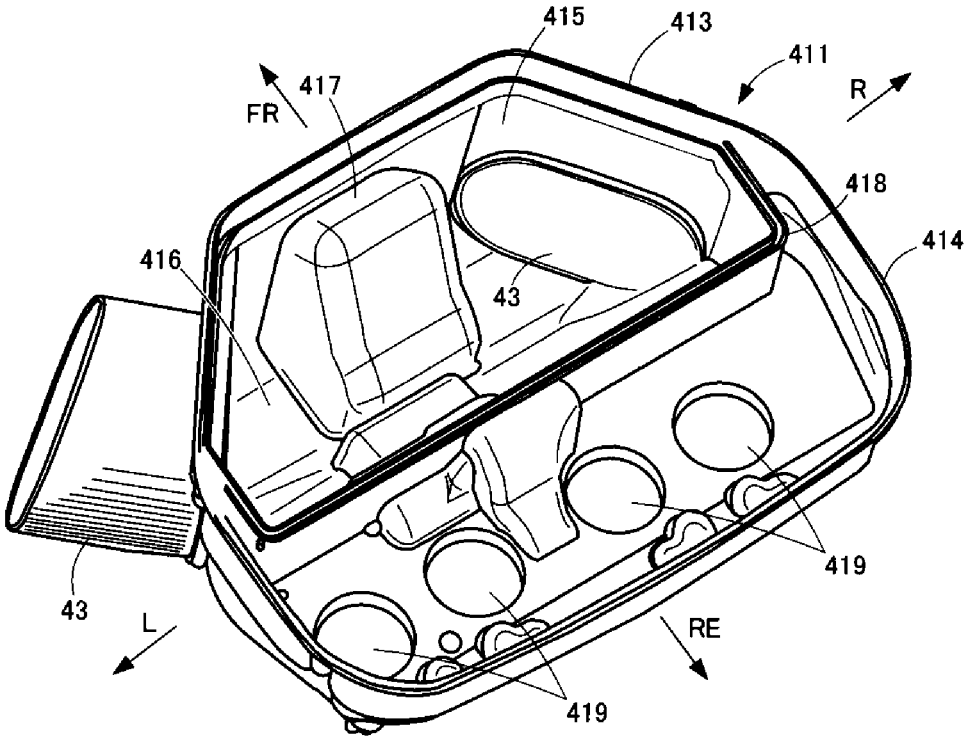
FIG. 6 is a perspective view in which an air cleaner cover is removed from the air cleaner according to the first embodiment.

First, the air cleaner 41 that forms the intake control device 10 according to the first embodiment will be described. FIG. 5 is a perspective view of the air cleaner 41 according to the present embodiment. FIG. 6 is a perspective view in which an air cleaner cover 412 is removed from the air cleaner 41 according to the present embodiment.

The air cleaner 41 is formed of a synthetic resin. As illustrated in FIG. 5 and FIG. 6, the air cleaner 41 is formed in a manner such that the air cleaner cover 412 whose lower surface is opened is attached to an air cleaner case 411 whose upper surface is opened. A substantially front half part 413 of the air cleaner case 411 bulges downward. Further, on the substantially front half part 413 of the air cleaner case 411, an outside air introducing chamber 415 is formed. The substantially front half part 413 of the air cleaner case 411 bulged downward is provided with the pair of right and left intake ducts 43 that extend forward. An outside air is introduced into the outside air introducing chamber 415 via the pair of right and left intake ducts 43.

Further, a part of a bottom part 416 of the air cleaner case 411 positioned on the substantially front half part 413 and between the pair of right and left intake ducts 43 bulges in the outside air introducing chamber 415. By the bulging part, on a rear surface of the air cleaner case 411, there is formed a recessed part 417 for disposing the sensor unit 45 (refer to FIG. 8A). By providing the recessed part 417 at a position between the pair of right and left intake ducts 43, a collision of intake flows from the pair of right and left intake ducts 43 is suppressed, resulting in that the intake flow in the outside air introducing chamber 415 is regulated. Note that details of a flow-regulating structure in the air cleaner 41 will be described later.

In the air cleaner case 411, a partition wall 418 is provided to surround the outside air introducing chamber 415. To the partition wall 418, a filter 462 (refer to FIG. 14) is attached to cover a portion above the outside air introducing chamber 415. An outside air flowed from the outside air introducing chamber 415 is cleaned by passing through the filter 462. As above, the inside of the air cleaner 41 is partitioned into a dirty side 460 and a clean side 461 by the filter 462 (refer to FIG. 14). On a substantially latter half part 414 of the air cleaner case 411, there are formed four openings 419 which are communicated with intake ports of respective cylinders of the engine unit 8. To the respective openings 419, air funnels 44 (refer to FIG. 9A) as outside air intake ports are attached.

The air cleaner cover 412 bulges in a substantially dome shape. With this structure, the clean side 461 is formed above the air cleaner case 411. In the air cleaner 41 structured as above, an outside air is introduced into the dirty side 460 from the intake ducts 43, and the outside air is sent to the clean side 461 through the filter 462. The outside air in the clean side 461 is fed to the intake ports of the engine unit 8 through the respective air funnels 44 (respective openings 419). At this time, in throttle bodies 82 provided between the air funnels 44 and the intake ports, an intake amount into the engine unit 8 is controlled. The control of the intake amount is conducted based on the operation amount of the throttle grip detected by the sensor unit 45.

Figure 7:
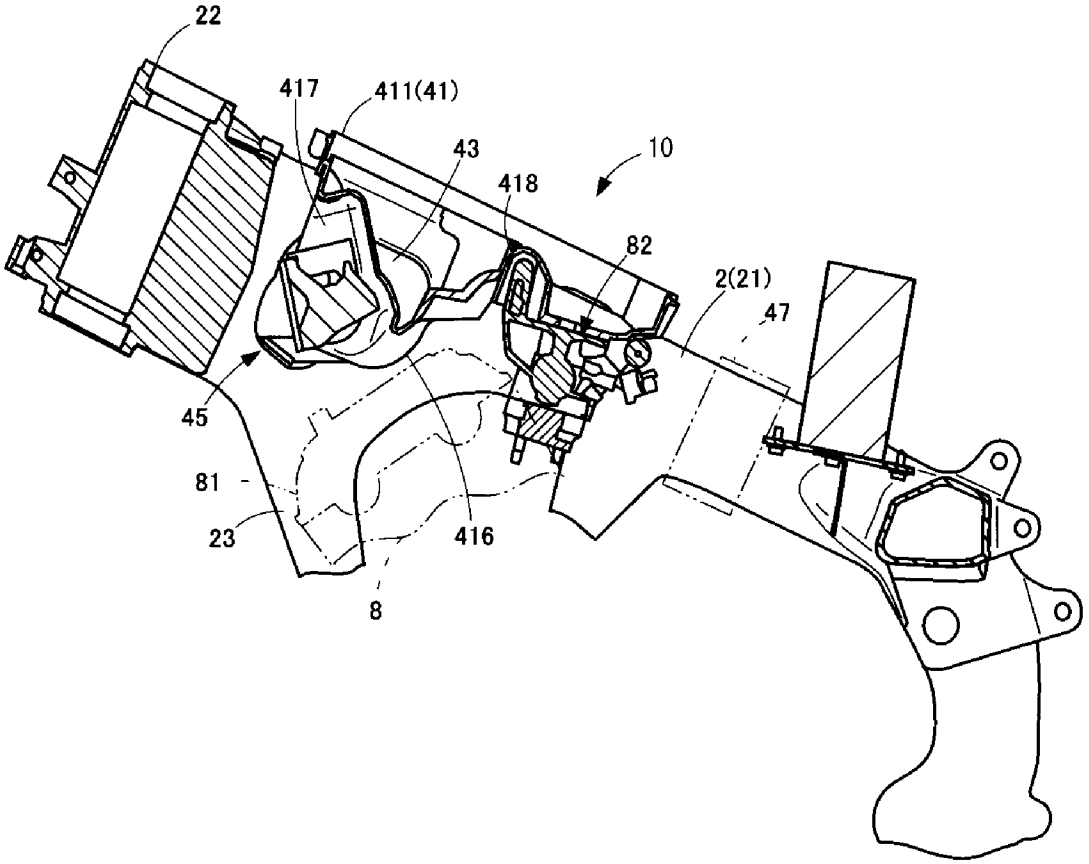
FIG. 7 is a sectional view of a part in the periphery of an intake control device according to the first embodiment.
Figure 8A:
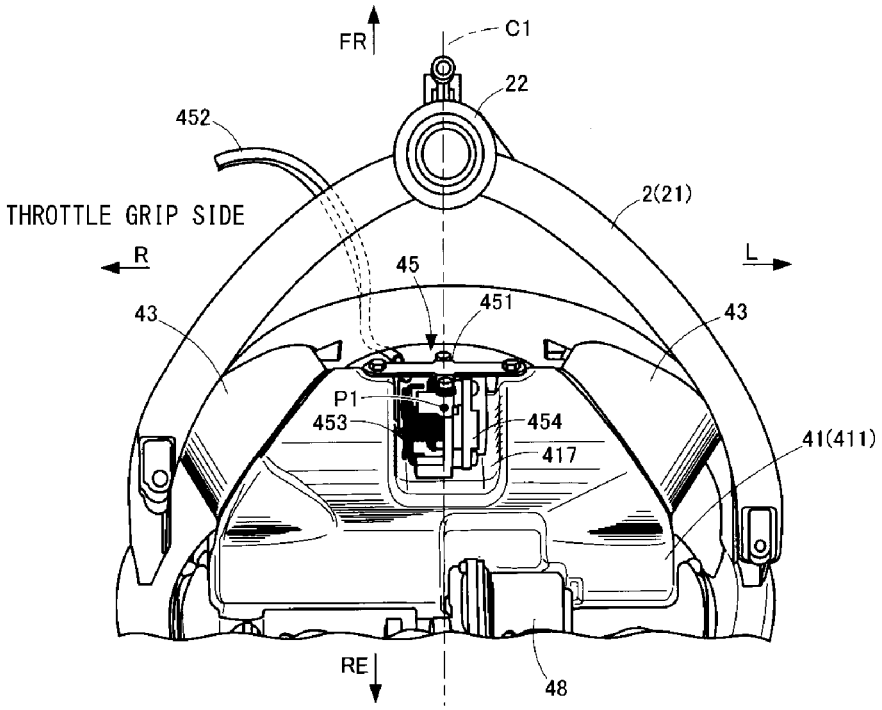
FIG. 8A is a bottom view of a part in the periphery of a sensor unit according to the first embodiment.

Next, explanation will be made on the sensor unit 45 according to the present embodiment while referring to FIG. 7 and FIG. 8A. FIG. 7 is a sectional view of a part in the periphery of the intake control device according to the present embodiment. FIG. 8A is a bottom view of a part in the periphery of the sensor unit 45 according to the present embodiment. Note that FIG. 7 is a view in which the main frame 21 and the air cleaner 41 are cut along a vertical plane on a vehicle body center line. Further, in FIG. 7, the engine unit 8 is illustrated by a two-dot chain line, for the convenience of explanation.

As illustrated in FIG. 7 and FIG. 8A, the air cleaner case 411 is positioned above a head cover 81 of the engine unit 8. To the recessed part 417 formed on the rear surface of the air cleaner case 411, the sensor unit 45 is attached by a bracket 451. The sensor unit 45 has a throttle pulley 453 and an accelerator position sensor 454. The throttle pulley 453 is coupled to the throttle grip via a throttle cable 452. The throttle pulley 453 rotates in conjunction with an operation of the throttle grip via the throttle cable 452. The accelerator position sensor 454 is attached to the throttle pulley 453.

The accelerator position sensor 454 detects the operation amount of the throttle grip in correspondence with a rotation amount of the throttle pulley 453. The accelerator position sensor 454 is connected to an ECU (Electronic Control Unit) 47 positioned behind the air cleaner case 411 via a harness (illustration is omitted). Further, the accelerator position sensor 454 outputs the operation amount of the throttle grip to the ECU 47. In the ECU 47, a throttle opening degree is calculated based on a detection result of the accelerator position sensor 454. Note that the ECU 47 is formed of a processor executing various types of processing, a memory and the like. The memory is formed of one or a plurality of storage media such as a ROM (Read Only Memory) and a RAM (Random access Memory), according to purposes. In the memory, a control program for controlling respective parts of the engine unit 8 and the like are stored.

The throttle opening degree calculated in the ECU 47 is output to an electric motor 48 provided at a lower part of the air cleaner 41. The electric motor 48 is coupled to throttle valves 83 (refer to FIG. 9) via a power transmission mechanism. The throttle valves 83 are rotatably supported in the throttle bodies 82. The throttle bodies 82 are disposed between the air cleaner case 411 and the intake ports of the engine unit 8. The electric motor 48 is driven based on the throttle opening degree input from the ECU 47, and the throttle valves 83 are opened/closed, to thereby control the intake amount into the engine unit 8 from the air cleaner 41.

Incidentally, the accelerator position sensor 454 according to the present embodiment is disposed above the engine unit 8 being a heat source in a separated manner. Further, the recessed part 417 in which the accelerator position sensor 454 is disposed is formed to bulge in the outside air introducing chamber 415 of the air cleaner 41. A wall surface 421 of the bulging part is disposed to overlap with the openings of the pair of right and left intake ducts 43 on the outside air introducing chamber 415 side, in a side view (refer to FIG. 9A). For this reason, an outside air introduced from the pair of right and left intake ducts 43 hits against the wall surface 421 to effectively cool the recessed part 417. With such a structure, a periphery of the accelerator position sensor 454 is maintained in a low atmospheric temperature, compared to a vicinity of the throttle bodies 82 and the like, for example. For this reason, the influence of temperature characteristics is reduced, resulting in that the detection accuracy of the accelerator position sensor 454 is improved.

Since the sensor unit 45 is attached to the air cleaner 41, it is approximated to the throttle grip in the height direction. The throttle pulley 453 of the sensor unit 45 is disposed disproportionately on the throttle grip side in the vehicle width direction, with respect to a vehicle body center line C1 extending in the front and rear directions of the vehicle body (refer to FIG. 8A). By the disposition as above, the throttle pulley 453 and the throttle grip are approximated in the height direction and the vehicle width direction, resulting in that the cable length of the throttle cable 452 can be reduced.

Figure 8B:
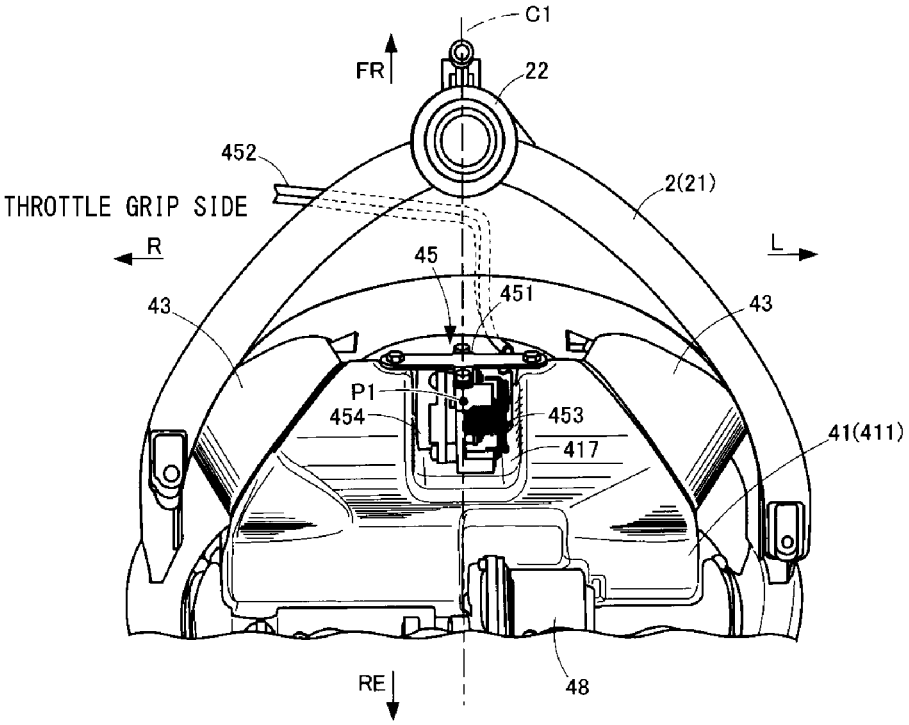
FIG. 8B is a view illustrating a structure in which the sensor unit in the structure illustrated in FIG. 8A is mirror-reversed.

At this time, the throttle cable 452 extended from the throttle pulley 453 is connected to the throttle grip without striding over the vehicle body center line C1. For this reason, the throttle cable 452 does not have to be steeply bent to avoid the head pipe 22, as in the structure illustrated in FIG. 8B in which the sensor unit 45 is mirror-reversed, and accordingly, it is possible to reduce the bending generated in the throttle cable 452. Note that FIG. 8B is a view illustrating a structure in which the sensor unit in the structure illustrated in FIG. 8A is mirror-reversed. By reducing the cable length, and reducing a curvature (increasing a radius of curvature) of the throttle cable, an operational resistance that acts on the throttle cable 452 can be reduced. Accordingly, the operationality of the throttle grip is improved.

Further, the sensor unit 45 is housed in the recessed part 417 of the air cleaner 41, so that there is no need to newly provide the installation space for the sensor unit 45, in addition to the installation space for the air cleaner 41. Accordingly, the sensor unit 45 and the air cleaner 41 can be disposed in a compact manner in the height direction with respect to the vehicle body. In this case, a periphery of the sensor unit 45 is covered by the recessed part 417, so that the maintainability of the sensor unit 45 is enhanced.

Further, the sensor unit 45 is attached to the air cleaner 41 via the bracket 451. Since the sensor unit 45 and the air cleaner 41 are unitized as above, an assembling easiness of the sensor unit 45 with respect to the vehicle body is improved. Note that the sensor unit 45 is only required to be disposed between the pair of intake ducts 43, and does not always have to be attached to the air cleaner 41. For example, the sensor unit 45 may also be attached to the intake duct 43.

In a state where the sensor unit 45 is attached to the recessed part 417 of the air cleaner 41, a center position P1 in the vehicle width direction of the sensor unit 45 is positioned on the vehicle body center line C1. Accordingly, it is possible to make a weight balance of right and left of the vehicle body to be close to a uniform one, to thereby improve a driving stability. Note that the sensor unit 45 is only required to be disposed to overlap with the vehicle body center line C1 in a top view. In particular, it is preferable that a center of gravity of the sensor unit 45 is positioned on the vehicle body center line C1.

Figure 9A:
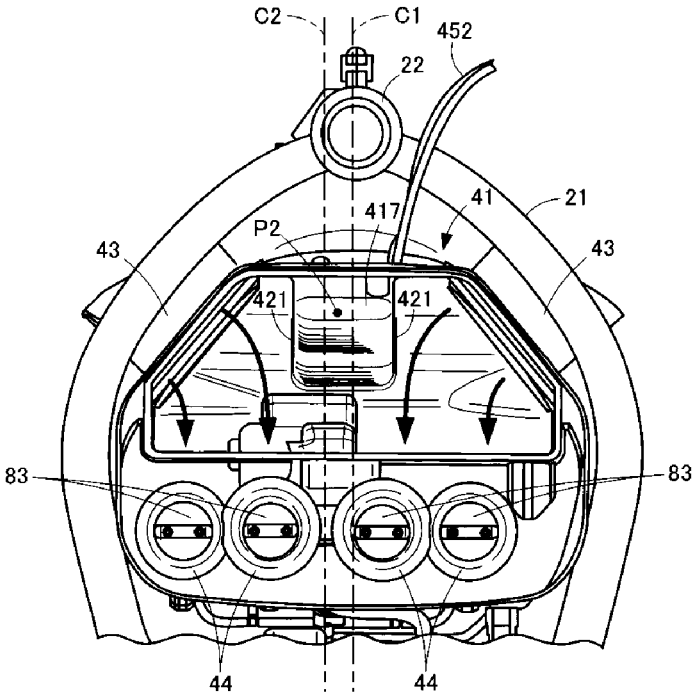
FIG. 9A is an explanatory view of a flow-regulating structure in the air cleaner according to the first embodiment.

The flow-regulating structure in the air cleaner 41 will be described with reference to FIG. 9A. FIG. 9A is an explanatory view of the flow-regulating structure in the air cleaner 41 according to the present embodiment.

As illustrated in FIG. 9A, the air cleaner 41 takes in an outside air from the pair of right and left intake ducts 43, and discharges the outside air toward the four air funnels 44 positioned on the downstream side. The series of air funnels 44 are disposed side by side in the vehicle width direction, and are disposed disproportionately on the vehicle width direction by a cam chain chamber of the engine unit 8 provided below the air cleaner 41. Specifically, a width center line passing through a center position in the vehicle width direction of the series of air funnels 44 (a symmetrical line by which the plurality of air funnels 44 are divided in a symmetrical manner) C2 is offset with respect to the vehicle body center line C1.

In the present embodiment, the recessed part 417 is provided between the pair of right and left intake ducts 43 so that the outside air can be uniformly fed to the offset respective air funnels 44. Since the recessed part 417 is formed to bulge in the air cleaner 41, the wall surface 421 of the bulging part is functioned as a flow-regulating plate between the pair of right and left intake ducts 43. The wall surface 421 of the recessed part 417 extends in the front and rear directions of the vehicle body so as to make an outside air introduced from right and left diagonal directions of the front of the vehicle body via the pair of right and left intake ducts 43 direct toward the rear of the vehicle body.

When the outside air introduced from the pair of right and left intake ducts 43 flows along the wall surface 421 of the recessed part 417, there are formed intake flows in the air cleaner 41 from the pair of right and left intake ducts 43 to the series of air funnels 44. By regulating the intake flows, a collision of intake flows from the pair of right and left intake ducts 43 is suppressed, which results in reducing an intake resistance. Further, the wall surface 421 is effectively cooled by the outside air, as described above. For this reason, a periphery of the accelerator position sensor 454 in the recessed part 417 is maintained in a low atmospheric temperature, compared to a vicinity of the throttle bodies 82 and the like, for example.

At this time, the recessed part 417 is positioned to overlap with the width center line C2 in a top view. By this recessed part 417, the intake flows which are uniform on the right and left are generated in the air cleaner 41, and it is possible to uniformly feed the outside air to the respective air funnels 44. Since the outside air is uniformly introduced into the respective air funnels 44, no variation is generated in an air-fuel ratio (A/F) of each cylinder of the engine unit 8. For this reason, a combustion state, an engine output and the like in each cylinder are equalized, resulting in that an engine vibration is reduced.

Figure 9B:
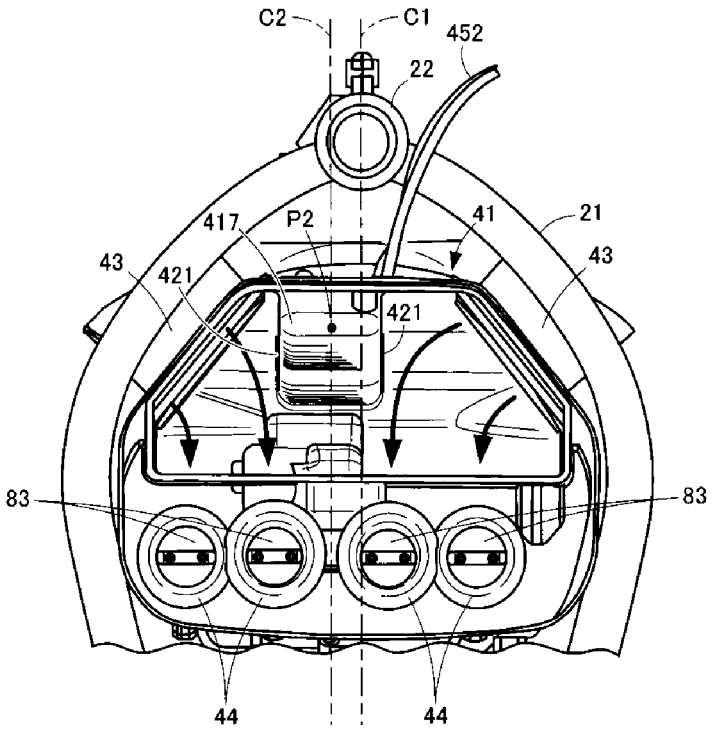
FIG. 9B is an explanatory view of the flow-regulating structure in the air cleaner according to the first embodiment.

Note that in the present embodiment, a center position P2 in the vehicle width direction of the recessed part 417 is offset with respect to the width center line C2, but, the present embodiment is not limited to this structure. It is also possible to adopt a structure in which the center position P2 in the vehicle width direction of the recessed part 417 is positioned on the width center line C2, as illustrated in FIG. 9B. FIG. 9B is an explanatory view of the flow-regulating structure in the air cleaner 41 according to the present embodiment, and is a view illustrating a structure in which the center position P2 in the vehicle width direction of the recessed part 417 is positioned on the width center line C2. With this structure, it is possible to generate right and left intake flows more uniformly, and to uniformly feed the outside air to the respective air funnels 44.

As described above, with the use of the intake control device according to the first embodiment, since the accelerator position sensor 454 is disposed in the recessed part 417 between the pair of right and left intake ducts 43, a periphery of the accelerator position sensor 454 is maintained in a low atmospheric temperature, compared to a vicinity of the throttle bodies 82 and the like. For this reason, the accuracy of detection performed by the accelerator position sensor 454 is improved, resulting in that the intake amount into the engine unit 8 is appropriately controlled based on the opening/closing of the throttle valves 83 in correspondence with the operation amount of the throttle grip. Further, the throttle pulley 453 is approximated to the throttle grip 62 in the height direction and the vehicle width direction, resulting in that the operationality of the throttle grip is improved.

Figure 10:
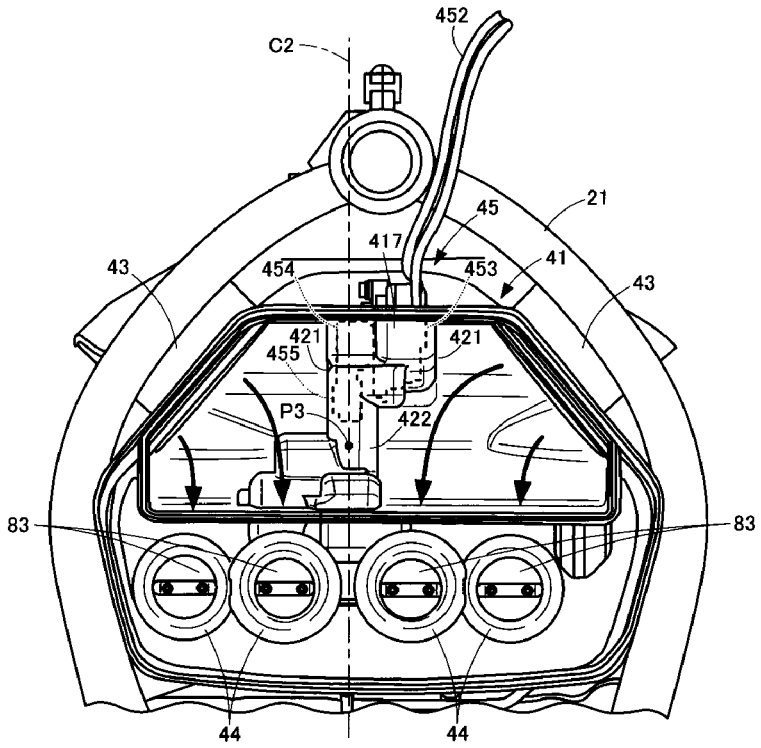
FIG. 10 is an explanatory view of a flow-regulating structure in an air cleaner according to a modified example of the first embodiment.

Here, a modified example of the first embodiment will be described. The intake control device 10 according to the above-described embodiment adopts a structure in which the recessed part 417 has a certain width dimension in the front and rear directions of the vehicle body, but, a structure thereof is not limited to this structure. For example, a structure as illustrated in a modified example in FIG. 10 may also be adopted. FIG. 10 is a view illustrating a modified example of the first embodiment. Note that in FIG. 10, components with the same names as those of the above-described embodiment are denoted by the same reference numerals. As illustrated in FIG. 10, it is also possible to adopt a structure in which a width-narrowed portion 422 is provided in the recessed part 417. The width-narrowed portion 422 is a portion in which a width becomes narrow from the upstream side toward the downstream side of the intake flow direction in the air cleaner 41. In this case, a coupler 455 projecting from the sensor unit 45 is disposed on the width-narrowed portion 422 by being directed toward the rear of the vehicle body. With this structure, when the ECU 47 is disposed on the rear part of the vehicle body, the length of harness from the coupler 455 to the ECU 47 can be reduced.

Further, since the width-narrowed portion 422 is provided, a linear dimension of the recessed part 417 in the front and rear directions of the vehicle body is enlarged. For this reason, a length of the wall surface 421 that functions as the flow-regulating plate in the air cleaner 41 becomes long in the front and rear directions of the vehicle body, resulting in that the effect of regulating the intake flows from the pair of right and left intake ducts 43 is enhanced. At this time, a center position P3 in the vehicle width direction of the width-narrowed portion 422 is positioned on the width center line C2. With this structure, it is possible to generate right and left intake flows more uniformly, and to uniformly feed the outside air to the respective air funnels 44.

Note that the width-narrowed portion 422 is only required to be disposed on the width center line C2 in a top view, and a structure thereof is not limited to a structure in which the center position P3 is positioned on the width center line C2. Even with such a structure, it is possible to generate right and left intake flows substantially uniformly, and to appropriately feed the outside air to the respective air funnels 44.

Figure 11:
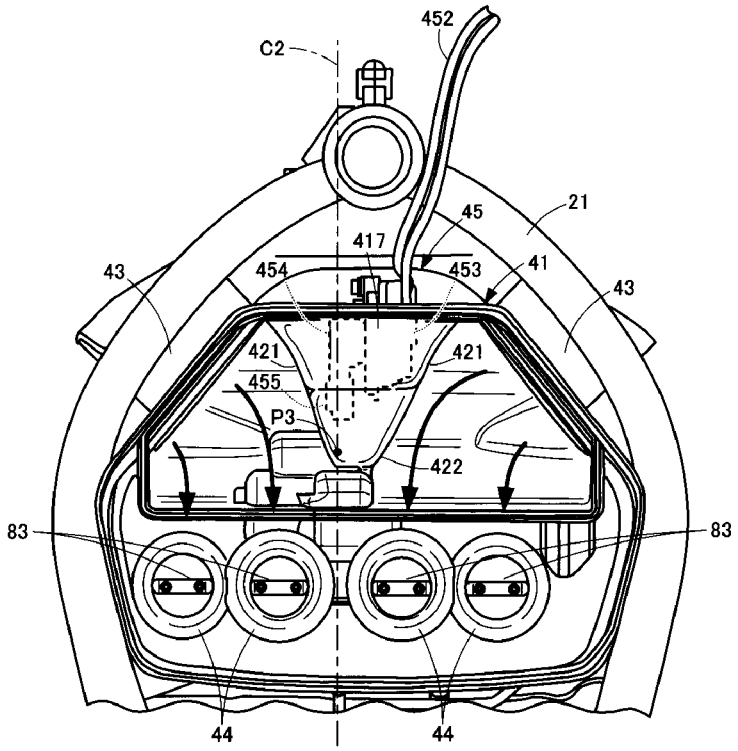
FIG. 11 is an explanatory view of a flow-regulating structure in an air cleaner according to another modified example of the first embodiment.

Further, it is also possible to adopt a structure as illustrated in another modified example in FIG. 11. FIG. 11 is a view illustrating another modified example of the first embodiment. In FIG. 11, components with the same names as those of the above-described embodiment are denoted by the same reference numerals. As illustrated in FIG. 11, the recessed part 417 may also be formed in a substantially V-shape in a top view with respect to the air cleaner 41. In this structure, the wall surface 421 of the recessed part 417 is formed to be along with the direction in which the pair of right and left intake ducts 43 project. Accordingly, a pressure loss caused by a collision between the outside air and the wall surface 421 is suppressed. Further, the effect of regulating the right and left intake flows in the air cleaner 41 is enhanced. Accordingly, it is possible to uniformly feed the outside air to the respective air funnels 44.

Note that the present embodiment adopts a structure in which the entire sensor unit 45 is housed in the recessed part 417, but, it is not limited to this structure. It is also possible to adopt a structure in which at least a part of the sensor unit 45 is housed in the recessed part 417. For example, a structure in which the recessed part 417 is formed shallowly, and only an upper half part of the sensor unit 45 is housed in the recessed part 417, may also be adopted. Further, a structure in which the recessed part 417 is not provided in the air cleaner 41, and the sensor unit 45 is disposed between the pair of intake ducts 43, may also be adopted. Even with this structure, since the sensor unit 45 is disposed by being sandwiched by the pair of intake ducts 43, it is possible to maintain the atmospheric temperature of a periphery of the sensor unit 45 to a low temperature, compared to a vicinity of the throttle bodies 82.

Further, in the intake control device according to the above-described embodiment, the recessed part 417 is disposed to overlap with the width center line C2 of the series of air funnels 44, but, a structure of the device is not limited to this structure. The recessed part 417 is only required to be disposed at least between the pair of right and left intake ducts 43. Further, in the intake control device according to the above-described embodiment, the sensor unit 45 is disposed to overlap with the vehicle body center line C1, but, a structure of the device is not limited to this structure. If the sensor unit 45 has a weight at a level of exerting no influence on the weight balance of the vehicle body, it may also be disposed at a position deviated from the vehicle body center line C1.

Figure 12:
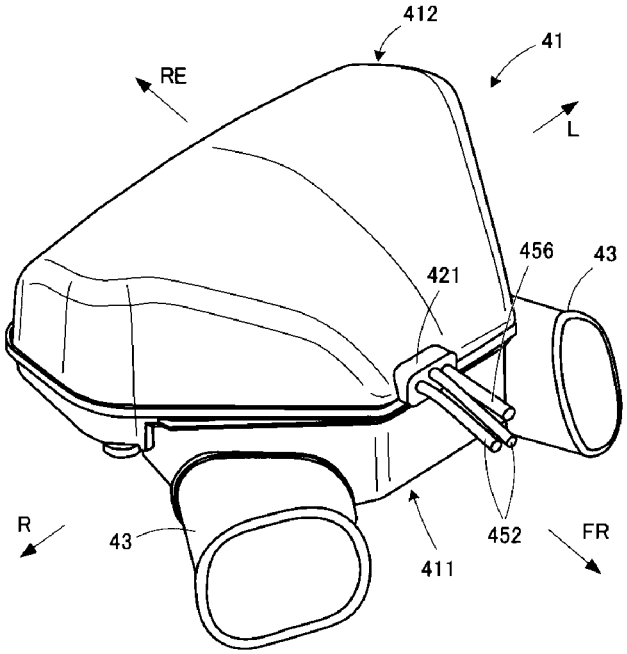
FIG. 12 is a perspective view of an air cleaner according to a second embodiment.
Figure 13:
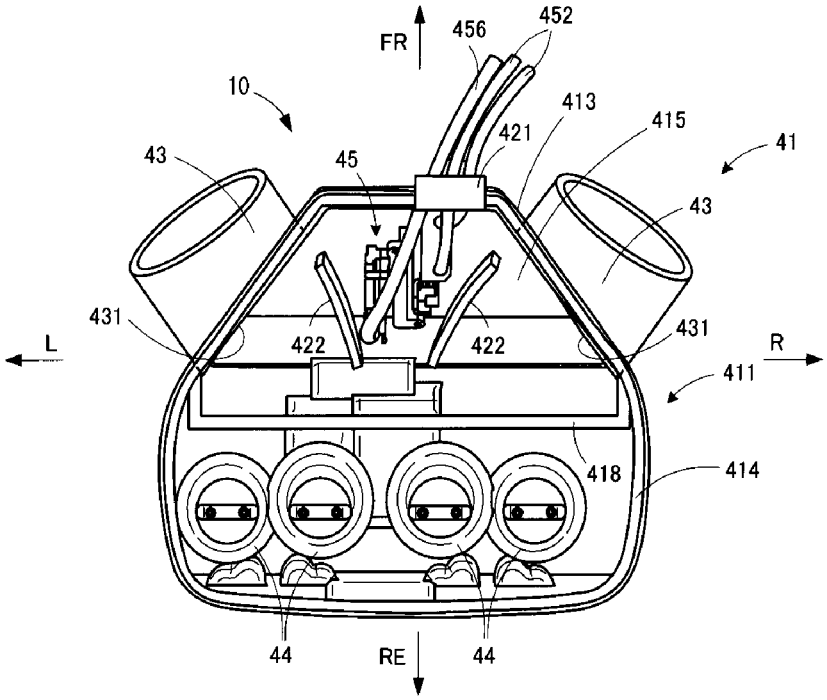
FIG. 13 is a top view in which an air cleaner cover is removed from the air cleaner according to the second embodiment.
Figure 14:
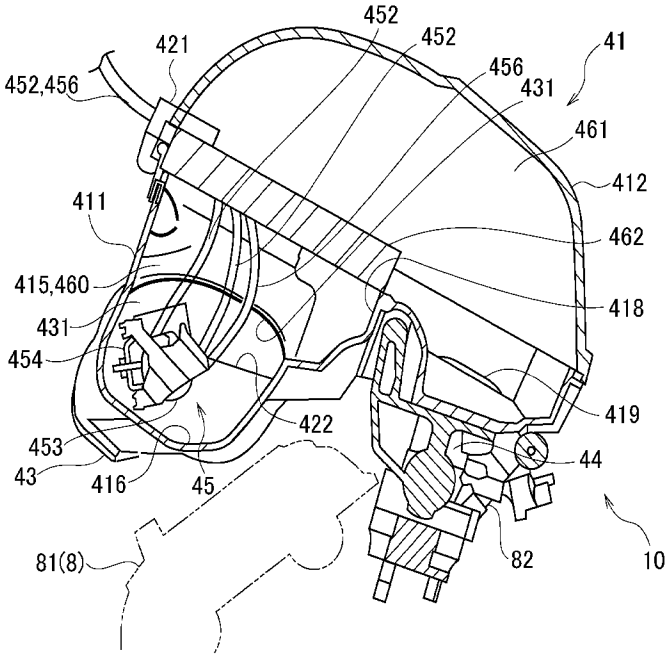
FIG. 14 is a sectional view of an intake control device according to the second embodiment.

Next, an intake control device 10 according to a second embodiment of the present invention will be described. The intake control device 10 according to the second embodiment includes an air cleaner 41, a pair of right and left intake ducts 43 projecting toward a front of a vehicle body from the air cleaner 41, and a sensor unit 45 detecting an operation amount of a throttle grip as an accelerator operating part. FIG. 12 is a perspective view of the air cleaner 41 according to the second embodiment. FIG. 13 is a top view in which an air cleaner cover 412 is removed from the air cleaner 41 according to the second embodiment. FIG. 14 is a sectional view schematically illustrating a structure of the intake control device 10 according to the second embodiment.

The air cleaner 41 is formed of a synthetic resin. As illustrated in FIG. 12 to FIG. 14, the air cleaner 41 is formed in a manner such that the air cleaner cover 412 whose lower surface is opened is attached to an air cleaner case 411 whose upper surface is opened. A substantially front half part 413 of the air cleaner case 411 bulges downward. Further, on the substantially front half part 413 of the air cleaner case 411, an outside air introducing chamber 415 is formed. The substantially front half part 413 of the air cleaner case 411 bulged downward is provided with the pair of right and left intake ducts 43 that extend forward. An outside air is introduced into the outside air introducing chamber 415 via the pair of right and left intake ducts 43.

To the outside air introducing chamber 415, the sensor unit 45 detecting the operation amount of the throttle grip is attached. The sensor unit 45 is disposed between openings 431 of the pair of right and left intake ducts 43 formed in the air cleaner 41. From the sensor unit 45, a harness 456 connected to an ECU (electronic Control Unit) 47 (refer to FIG. 15) and a throttle cable 452 connected to the throttle grip are extended. The harness 456 and the throttle cable 452 are drawn out from a front end portion of the air cleaner 41 toward the front of the vehicle body. To a mating surface of this front end portion between the air cleaner case 411 and the air cleaner cover 412, a seal rubber 421 sealing the harness 456 and the throttle cable 452 is attached.

Further, in the outside air introducing chamber 415, a pair of flow-regulating plates 422 are provided to sandwich the sensor unit 45 in the vehicle width direction. The pair of flow-regulating plates 422 prevent water droplet and dust from the outside from entering the sensor unit 45 side, between the sensor unit 45 and the openings 431 of the pair of right and left intake ducts 43. The pair of flow-regulating plates 422 are disposed in a substantially V-shape in a top view so as to reduce an interval therebetween from the front end portion of the air cleaner 41 toward the rear direction. By the disposition of the pair of flow-regulating plates 422, a flow of an outside air taken from the pair of right and left intake ducts 43 is regulated. Note that details of a flow-regulating structure in the air cleaner 41 will be described later.

In the air cleaner case 411, a partition wall 418 is provided to surround the outside air introducing chamber 415. To the partition wall 418, a filter 462 is attached to cover a portion above the outside air introducing chamber 415. An outside air flowed from the outside air introducing chamber 415 is cleaned by passing through the filter 462. As above, the inside of the air cleaner 41 is partitioned into a dirty side 460 and a clean side 461 by the filter 462. To a substantially latter half part 414 of the air cleaner case 411, air funnels 44 as outside air intake ports are attached by corresponding to intake ports of respective cylinders of an engine unit 8.

The air cleaner cover 412 bulges in a substantially dome shape. Further, the air cleaner cover 412 forms the clean side 461 above the air cleaner case 411. In the air cleaner 41 structured as above, an outside air is introduced into the dirty side 460 from the intake ducts 43, and the outside air is sent to the clean side 461 through the filter 462. The outside air in the clean side 461 is fed to the intake ports of the engine unit 8 through the respective air funnels 44. At this time, in throttle bodies provided between the air funnels 44 and the intake ports, an intake amount into the engine unit 8 is controlled. The control of the intake amount is conducted based on the operation amount of the throttle grip detected by the sensor unit 45. As described above, in the air cleaner 41, the filter 462 is provided to partition the dirty side 460 on the upstream side and the clean side 461 on the downstream side of the intake flow direction. Further, the sensor unit 45 is disposed on the dirty side 460.

Figure 15:
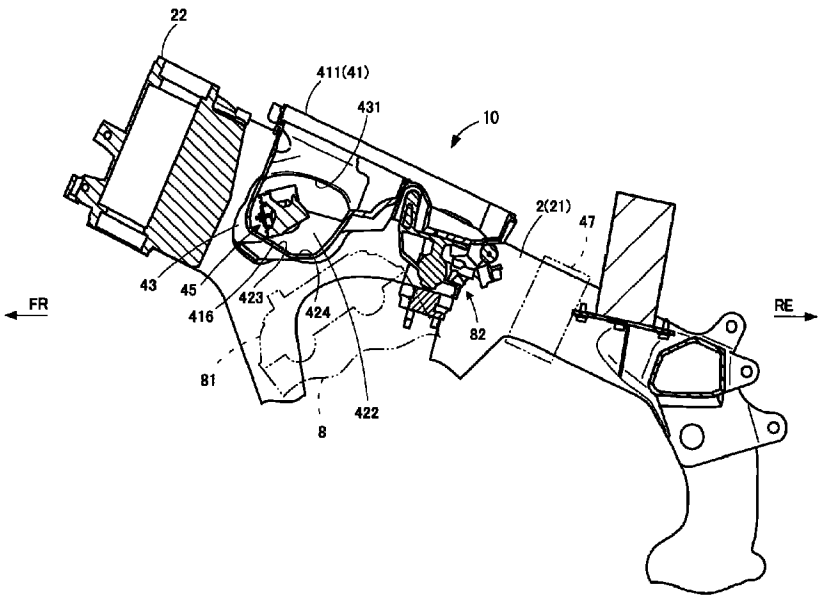
FIG. 15 is a sectional view of a part in the periphery of the intake control device according to the second embodiment.
Figure 16A:
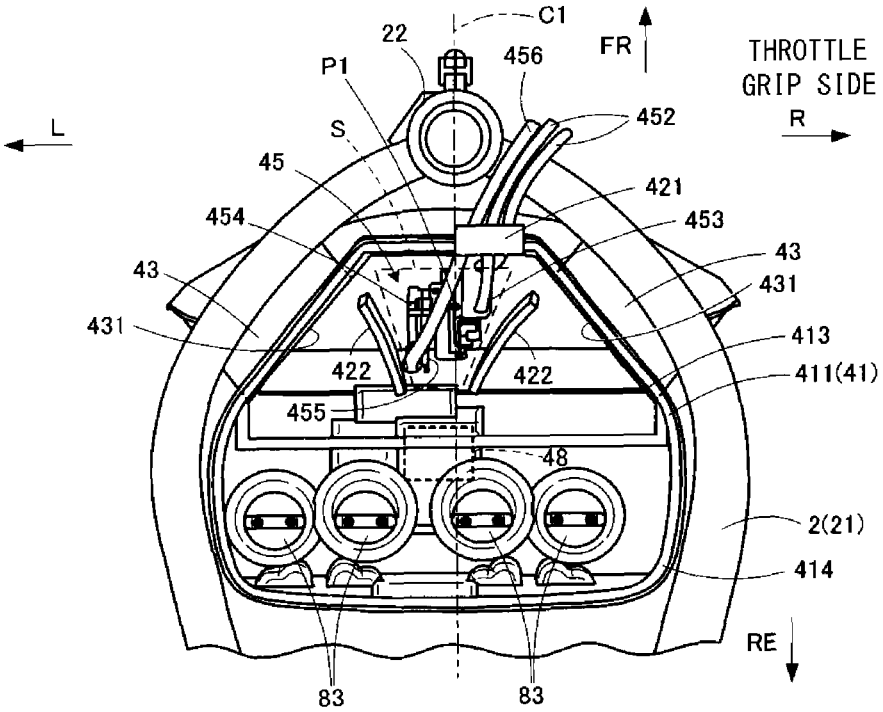
FIG. 16A is a top view of a part in the periphery of the intake control device according to the second embodiment.

Next, explanation will be made on the sensor unit 45 according to the present embodiment while referring to FIG. 15 and FIG. 16A. FIG. 15 is a sectional view of a part in the periphery of the intake control device according to the present embodiment. FIG. 16A is a top view of a part in the periphery of the intake control device according to the present embodiment. Note that FIG. 15 is a view in which the main frame 21 and the air cleaner 41 are cut along a vertical plane on a vehicle body center line C1. Further, in FIG. 15, the engine unit 8 is illustrated by a two-dot chain line, for the convenience of explanation. In FIG. 16A, an electric motor 48 is illustrated by a two-dot chain line, for the convenience of explanation.

As illustrated in FIG. 15 and FIG. 16A, the air cleaner case 411 is positioned above a head cover 81 of the engine unit 8. In the air cleaner case 411, the sensor unit 45 is attached by a bracket (not illustrated). The sensor unit 45 has a throttle pulley 453 and an accelerator position sensor 454. The throttle pulley 453 is coupled to the throttle grip via the throttle cable 452. The throttle pulley 453 rotates in conjunction with an operation of the throttle grip via the throttle cable 452. The accelerator position sensor 454 is attached to the throttle pulley 453.

The accelerator position sensor 454 detects the operation amount of the throttle grip in correspondence with a rotation amount of the throttle pulley 453. The accelerator position sensor 454 is connected to an ECU 47 positioned behind the air cleaner case 411 via the harness 456, and outputs the operation amount of the throttle grip to the ECU 47. In the ECU 47, a throttle opening degree is calculated based on a detection result of the accelerator position sensor 454. Note that the ECU 47 is formed of a processor executing various types of processing, a memory and the like. The memory is formed of one or a plurality of storage media such as a ROM (Read Only Memory) and a RAM (Random access Memory), according to purposes. In the memory, a control program for controlling respective parts of the engine unit 8 and the like are stored.

The throttle opening degree calculated in the ECU 47 is output to the electric motor 48 provided at a lower part of the air cleaner 41. The electric motor 48 is coupled to throttle valves 83 via a power transmission mechanism. The throttle valves 83 are rotatably supported in the throttle bodies 82. The throttle bodies 82 are disposed between the air cleaner case 411 and the intake ports of the engine unit 8. The electric motor 48 is driven based on the throttle opening degree input from the ECU 47, and the throttle valves 83 are opened/closed, to thereby control the intake amount into the engine unit 8 from the air cleaner 41.

The accelerator position sensor 454 according to the present embodiment is disposed in the air cleaner 41 which is positioned above the engine unit 8 being a heat source in a separated manner. In the air cleaner 41, the accelerator position sensor 454 is disposed to overlap with the openings 431 of the pair of right and left intake ducts 43 in a side view. By the pair of flow-regulating plates 422, an installation space S for the accelerator position sensor 454 is formed in a substantially V-shape in a top view in which a width becomes narrow toward the rear direction. The accelerator position sensor 454 is disposed by directing the coupler 455 to the rear side of the installation space S in which the width is narrow.

When the outside air introduced from the pair of right and left intake ducts 43 flows along the pair of flow-regulating plates 422, the installation space S in a periphery of the accelerator position sensor 454 is effectively cooled. By the introduction of the outside air, the periphery of the accelerator position sensor 454 is maintained in a low atmospheric temperature, compared to a vicinity of the throttle bodies 82 and the like, for example. For this reason, the influence of temperature characteristics can be reduced, resulting in that the detection accuracy of the accelerator position sensor 454 can be improved.

Since the sensor unit 45 is attached in the air cleaner 41, it is approximated to the throttle grip in the height direction. The throttle pulley 453 of the sensor unit 45 is disposed disproportionately on the throttle grip side in the vehicle width direction, with respect to the vehicle body center line C1 extending in the front and rear directions of the vehicle body. By the disposition as above, the throttle pulley 453 and the throttle grip are approximated in the height direction and the vehicle width direction, resulting in that the cable length of the throttle cable 452 drawn out from the air cleaner 41 toward the front of the vehicle body can be reduced.

The throttle cable 452 and the harness 456 are drawn out from the air cleaner 41 toward the front direction via the seal rubber 421 facing the throttle pulley 453 in the front and rear directions of the vehicle body. At this time, the seal rubber 421 is also disposed disproportionately on the throttle grip side in the vehicle width direction with respect to the vehicle body center line C1. For this reason, the throttle cable 452 extended from the throttle pulley 453 toward the front of the vehicle body is connected to the throttle grip without striding over the vehicle body center line C1.

Figure 16B:
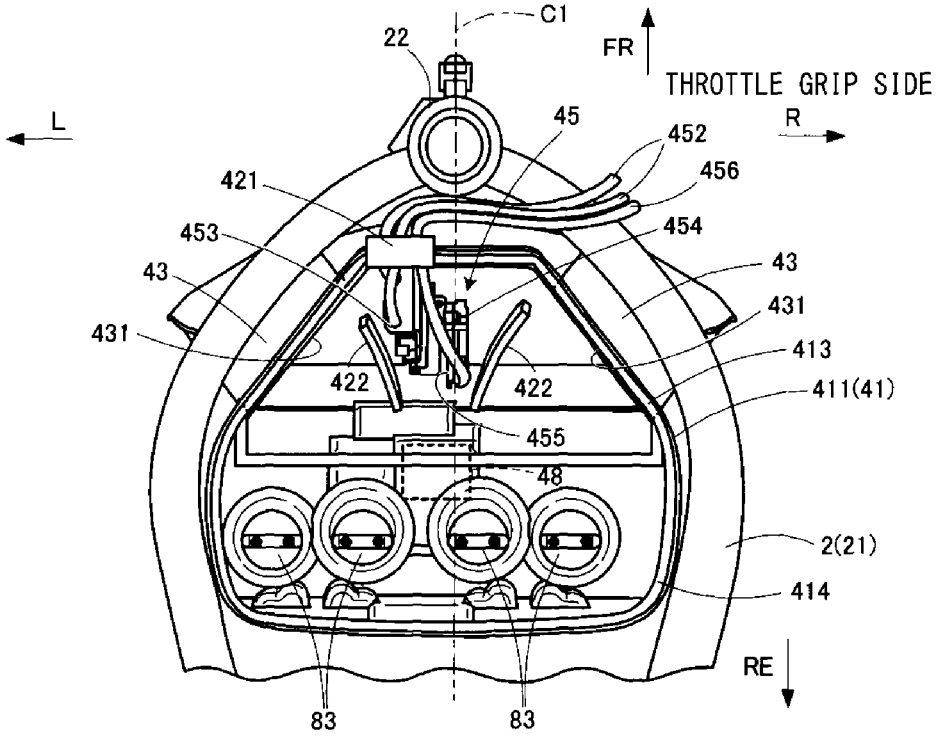
FIG. 16B is a view illustrating a structure in which a sensor unit in the structure illustrated in FIG. 16A is mirror-reversed.

Accordingly, the throttle cable 452 does not have to be steeply bent to avoid the head pipe 22, as in the structure illustrated in FIG. 16B in which the sensor unit 45 is mirror-reversed, and it is possible to reduce the bending generated in the throttle cable 452. FIG. 16B is a view schematically illustrating a structure in which the sensor unit 45 in the structure in FIG. 16A is mirror-reversed. In the present embodiment, by reducing the cable length, and reducing a curvature (increasing a radius of curvature) of the throttle cable 452, an operational resistance that acts on the throttle cable 452 is reduced, resulting in that the operationality of the throttle grip is improved.

Further, the sensor unit 45 is housed in the air cleaner 41, so that there is no need to newly provide the installation space for the sensor unit 45, in addition to the installation space for the air cleaner 41. Accordingly, the sensor unit 45 and the air cleaner 41 can be disposed in a compact manner in the height direction with respect to the vehicle body. Further, since the sensor unit 45 is housed in the air cleaner 41, adhesion of foreign substances such as water droplet and dust with respect to the sensor unit 45 is suppressed. Further, the sensor unit 45 is protected from an external impact.

Figure 17:
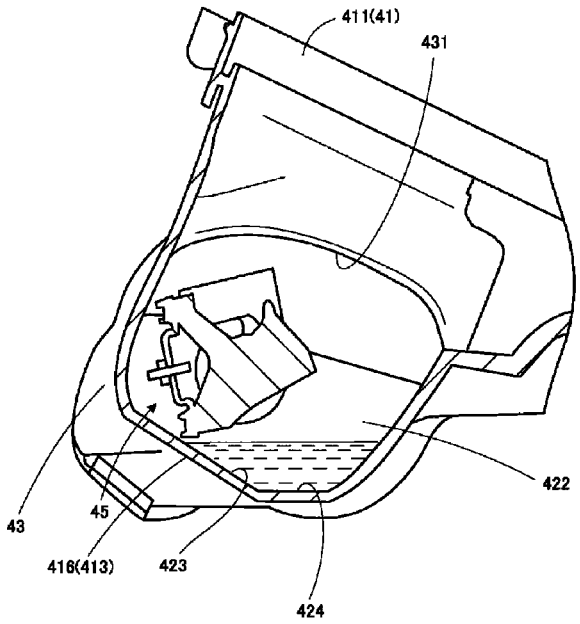
FIG. 17 is a view illustrating an example in which rainwater enters the air cleaner according to the second embodiment.

FIG. 17 is a sectional view schematically illustrating a structure of a front part of the air cleaner case 411, and is a view schematically illustrating a state in which rainwater or the like enters the inside of the air cleaner 41. As illustrated in FIG. 17, the air cleaner case 411 is formed in a manner such that the substantially front half part 413 bulges downward. The bottom part 416 of the substantially front half part 413 inclines rearward and downward on the front side, and inclines forward and downward on the rear side. In the air cleaner 41, the sensor unit 45 is attached to an inclined surface 423 on the front side of the bottom part 416. Specifically, the sensor unit 45 is disposed at a position higher than a lowest surface 424 positioned between the front side and the rear side of the bottom part 416. Accordingly, even if rainwater enters the inside of the air cleaner 41 from the intake ducts 43, the sensor unit 45 can be separated from the rainwater accumulated on the lowest surface 424, resulting in that a trouble of the accelerator position sensor 454 is prevented.

Returning to FIG. 16A, in a state where the sensor unit 45 is attached to the inside of the air cleaner 41, the center position P1 in the vehicle width direction of the sensor unit 45 is positioned on the vehicle body center line C1. Accordingly, it is possible to make a weight balance of right and left of the vehicle body to be close to a uniform one, so that the driving stability is improved. Note that the sensor unit 45 is only required to be disposed to overlap with the vehicle body center line C1 in a top view. In particular, it is preferable that a center of gravity of the sensor unit 45 is positioned on the vehicle body center line C1.

Figure 18A:
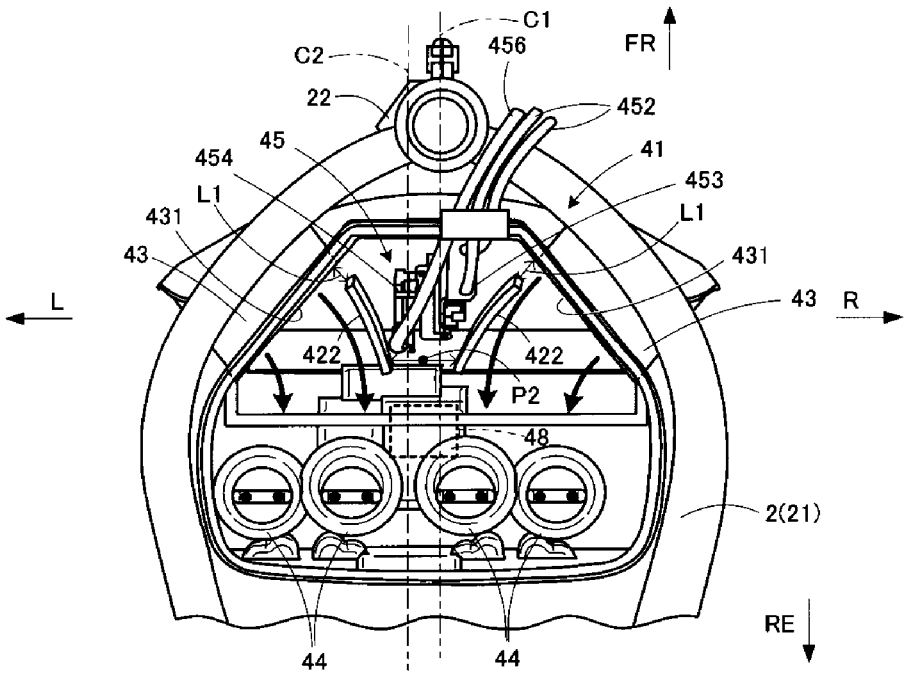
FIG. 18A is an explanatory view of a flow-regulating structure in the air cleaner according to the second embodiment.

Next, the flow-regulating structure in the air cleaner 41 will be described with reference to FIG. 18A. FIG. 18A is an explanatory view of the flow-regulating structure in the air cleaner 41 according to the present embodiment.

As illustrated in FIG. 18A, the air cleaner 41 takes in an outside air from the pair of right and left intake ducts 43, and discharges the outside air toward the four air funnels 44 positioned on the downstream side. The series of air funnels 44 are disposed side by side in the vehicle width direction, and are disposed disproportionately on the vehicle width direction by a cam chain chamber of the engine unit 8 provided below the air cleaner 41. Specifically, a width center line passing through a center position in the vehicle width direction of the series of air funnels 44 (a symmetrical line by which the plurality of air funnels 44 are divided in a symmetrical manner) C2 is offset with respect to the vehicle body center line C1.

In the present embodiment, the pair of flow-regulating plates 422 are provided in the air cleaner 41 so that the outside air can be uniformly fed to the offset respective air funnels 44. The pair of flow-regulating plates 422 are positioned between the openings 431 of the pair of right and left intake ducts 43 and the sensor unit 45, and form intake flows on both sides of the sensor unit 45. The pair of flow-regulating plates 422 extend in an arc shape in the front and rear directions of the vehicle body. With this structure, it is possible to make an outside air introduced from right and left diagonal directions of the front of the vehicle body via the pair of right and left intake ducts 43 direct toward the rear of the vehicle body.

When the outside air introduced from the pair of right and left intake ducts 43 flows along the pair of flow-regulating plates 422, there are formed intake flows in the air cleaner 41 from the pair of right and left intake ducts 43 to the series of air funnels 44. As described above, the flow-regulating plates 422 effectively regulate the intake flows in the air cleaner 41, which suppresses an increase in pressure loss caused by a disturbance of intake. Further, as described above, the pair of flow-regulating plates 422 are effectively cooled by the outside air, resulting in that a periphery of the accelerator position sensor 454 sandwiched by the pair of flow-regulating plates 422 is maintained in a low atmospheric temperature.

Further, the pair of flow-regulating plates 422 are disposed by providing a gap L1 between each plate and the wall surface of the air cleaner case 411. By providing the gap L1, an intake flow is generated also in the periphery of the sensor unit 45 in the inside of the pair of flow-regulating plates 422. For example, in a low speed range of the engine unit 8 in which a flow speed is low, not only an outside air from the pair of right and left intake ducts 43 but also an air in the periphery of the sensor unit 45 in the inside of the pair of flow-regulating plates 422 is fed to the air funnels 44. Accordingly, in the air cleaner 41, even when a sufficient flow speed cannot be achieved, the transient performance of the engine unit 8 is improved.

At this time, the pair of flow-regulating plates 422 are positioned to sandwich the width center line C2. By the disposition of the pair of flow-regulating plates 422, the intake flows which are uniform on the right and left are generated in the air cleaner 41, and the outside air is uniformly fed to the respective air funnels 44. Since the outside air is uniformly introduced into the respective air funnels 44, no variation is generated in an air-fuel ratio (A/F) of each cylinder of the engine unit 8. For this reason, a combustion state, an engine output and the like in each cylinder are equalized, resulting in that an engine vibration is reduced.

Figure 18B:
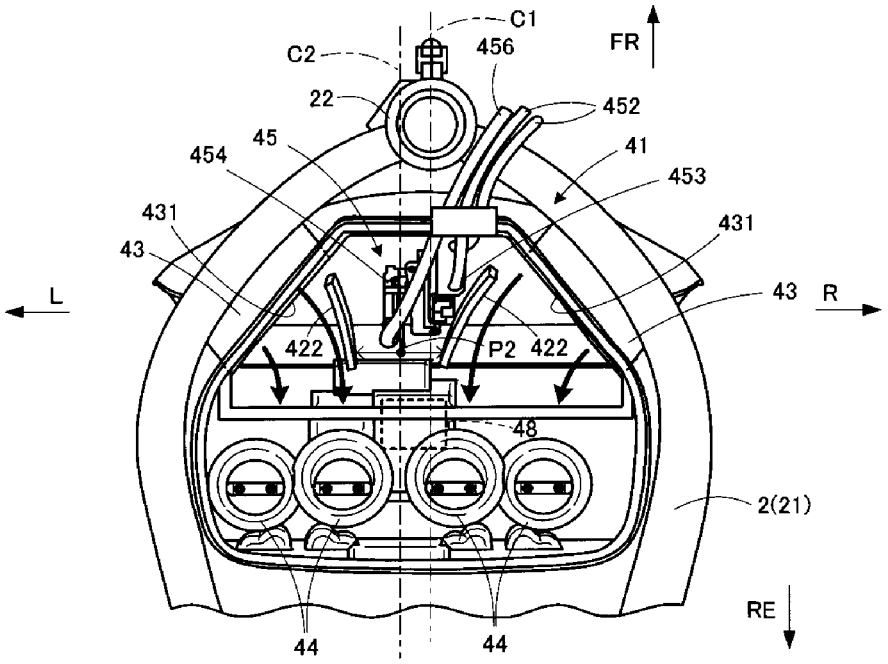
FIG. 18B is an explanatory view of the flow-regulating structure in the air cleaner according to the second embodiment.

Note that in the present embodiment, a center position P2 of an interval between the facing pair of flow-regulating plates 422 is offset with respect to the width center line C2, but, the present embodiment is not limited to this structure. It is also possible to adopt a structure in which the center position P2 of the interval between the facing pair of flow-regulating plates 422 is positioned on the width center line C2, as illustrated in FIG. 18B. FIG. 18B is a view schematically illustrating a structure in which the center position P2 of the interval between the facing pair of flow-regulating plates 422 is positioned on the width center line C2. With this structure, it is possible to generate right and left intake flows more uniformly, and to uniformly feed the outside air to the respective air funnels 44.

As described above, according to the intake control device 10 according to the second embodiment, the sensor unit 45 is disposed in the air cleaner 41 by being sandwiched by the openings 431 of the pair of right and left intake ducts 43. Accordingly, by the outside air that flows into the air cleaner 41 from the intake ducts 43, a periphery of the sensor unit 45 is maintained in a low atmospheric temperature, compared to a periphery of the throttle bodies 82 and the like, for example. For this reason, the accuracy of detection performed by the accelerator position sensor 454 is improved, resulting in that the intake amount into the engine unit 8 is appropriately controlled based on the opening/closing of the throttle valves 83 in correspondence with the operation amount of the throttle grip.

Further, since the sensor unit 45 is provided above the engine unit 8, the length of the throttle cable 452 connected to the sensor unit 45 from the accelerator operating part can be reduced. For this reason, the operationality of the accelerator operating part can be improved by reducing the operational resistance that acts on the throttle cable 452. Further, since the sensor unit 45 is disposed in the air cleaner 41, the adhesion of foreign substances such as water droplet and dust with respect to the sensor unit 45 is suppressed, and further, the sensor unit 45 can be protected from an external impact.

Figure 19:
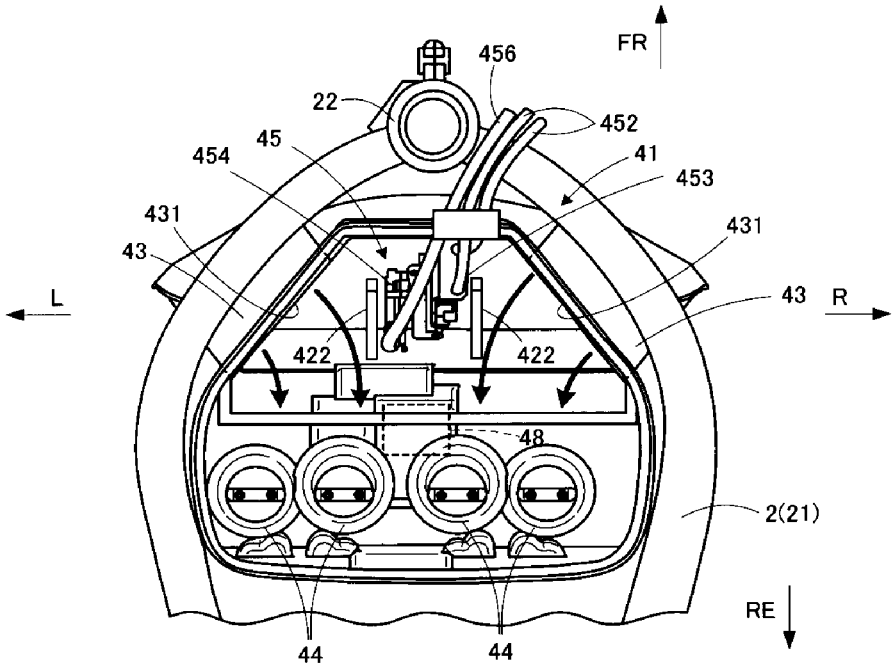
FIG. 19 is an explanatory view of a flow-regulating structure in an air cleaner according to a modified example of the second embodiment.

Here, a modified example of the second embodiment will be described. The intake control device according to the second embodiment described above adopts a structure in which the pair of flow-regulating plates 422 are disposed in a substantially V-shape in a top view in the air cleaner 41, but, a structure thereof is not limited to this structure. The pair of flow-regulating plates 422 are only required to be able to guide the outside air introduced from the pair of right and left intake ducts 43 to the air funnels 44. For example, it is possible to adopt a structure in which a pair of parallel flow-regulating plates 422 are disposed in the air cleaner 41 in the front and rear directions of the vehicle body, as illustrated in FIG. 19.

Figure 20:
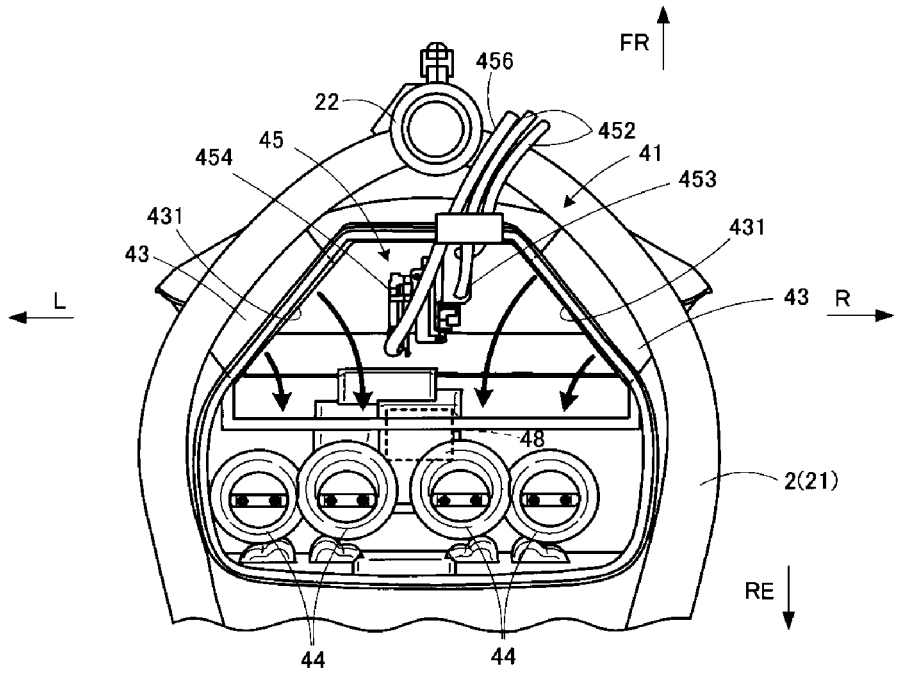
FIG. 20 is an explanatory view of a flow-regulating structure in an air cleaner according to another modified example of the second embodiment.

Further, as illustrated in FIG. 20, a structure in which the pair of flow-regulating plates 422 are not disposed in the air cleaner 41, may also be adopted. In this case, both side surfaces of the sensor unit 45 function as flow-regulating plates, and intake flows which are uniform on the right and left are generated in the air cleaner 41. With this structure, it becomes possible to uniformly feed the outside air to the plurality of air funnels 44. Note that in FIG. 19 and FIG. 20, components with the same names as those of the above-described embodiment are denoted by the same reference numerals.

As above, the respective embodiments of the present invention have been described in detail with reference to the drawings, but, the present invention is not limited to the above-described respective embodiments, and can be implemented while being variously modified. In the above-described respective embodiments, a size, a shape and the like illustrated in the accompanying drawings are not limited to the illustrated ones, and can be appropriately modified within a range of exerting the effect of the present invention. Additionally, the present invention can be implemented while being appropriately modified without departing from the scope of the present invention.

Further, in the intake control device according to each embodiment, explanation was made by exemplifying the throttle grip as the accelerator operating part, but, a structure of the devices is not limited to this structure. The accelerator operating part is only required to be able to adjust the opening degree of the throttle valves, and may also be formed of a throttle lever or the like, for example.

Further, although the intake control device according to each embodiment adopts a structure in which the sensor unit 45 has the accelerator position sensor 454 and the throttle pulley 453, a structure thereof is not limited to this structure. Any structure can be adopted as long as the sensor unit 45 is coupled to the accelerator operating part via the throttle cable 452 and can detect the operation amount of the accelerator operating part.

Further, although the intake control device according to each embodiment adopts a structure in which the sensor unit 45 is disposed to overlap with the vehicle body center line C1, a structure thereof is not limited to this structure. If the sensor unit 45 has a weight at a level of exerting no influence on the weight balance of the vehicle body, it may also be disposed at a position deviated from the vehicle body center line C1.

According to an intake control device of the present invention, it is possible to improve an operationality of an accelerator operating part and to enhance a detection accuracy of an accelerator position sensor.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

The present invention is an effective technique for an intake control device of a motorcycle. Particularly, the present invention is an effective technique for an intake control device which electronically controls an intake amount of engine. Further, according to the present invention, it is possible to improve an operationality of an accelerator operating part, and to enhance a detection accuracy of an accelerator position sensor.

What is claimed is:

1. An intake control device controlling an intake amount of engine based on opening/closing of throttle valves in correspondence with an operation amount of an accelerator operating part, the intake control device comprising:

an air cleaner disposed above the engine and connected to the engine via the throttle valves;

a pair of right and left intake ducts projecting toward a front of a vehicle body from said air cleaner to take an outside air in said air cleaner; and a sensor unit coupled to a throttle cable extended from the accelerator operating part, and detecting the operation amount of the accelerator operating part, wherein said sensor unit is disposed to overlap with at least a part of said pair of right and left intake ducts in a side view, at a position above the engine and below said air cleaner, the sensor unit has an accelerator position sensor, a signal of the accelerator position sensor drives an electric motor opening/closing the throttle valves, the accelerator position sensor is provided between the intake ducts provided at a front half part of the air cleaner, and air funnels are provided at a rear half of the air cleaner.

2. The intake control device according to claim 1, wherein:

on a bottom part of said air cleaner, a recessed part is formed, between said pair of right and left intake ducts, to bulge in said air cleaner; and at least a part of said sensor unit is housed in the recessed part.

3. The intake control device according to claim 2, wherein:

a plurality of outside air intake ports through which an air is taken in the engine are provided in said air cleaner; and the recessed part is disposed to overlap with a width center line passing through a center of width in a vehicle width direction of the plurality of outside air intake ports and extending in front and rear directions of the vehicle body, in a top view.

4. The intake control device according to claim 3, wherein a center position in the vehicle width direction of the recessed part is positioned on the width center line.

5. The intake control device according to claim 3, wherein the recessed part has a width-narrowed portion in which a width becomes narrow from an upstream side toward a downstream side of an intake flow direction in said air cleaner.

6. The intake control device according to claim 5, wherein a coupler extending rearward from said sensor unit is disposed on the width-narrowed portion of the recessed part.

7. The intake control device according to claim 5, wherein a center position in the vehicle width direction of the width-narrowed portion of the recessed part is positioned on the width center line in the vehicle width direction.

8. The intake control device according to claim 1, wherein said sensor unit is disposed to overlap with a vehicle body center line extending in front and rear directions of the vehicle body, in a top view.

9. The intake control device according to claim 8, wherein a center position in a vehicle width direction of said sensor unit is positioned on the vehicle body center line.

10. The intake control device according to claim 1, wherein:

said sensor unit has a throttle pulley that rotates in conjunction with the operation of the accelerator operating part via the throttle cable, and the accelerator position sensor that detects the operation amount of the accelerator operating part in correspondence with a rotation amount of the throttle pulley; and the throttle pulley is disposed disproportionately on a side of the accelerator operating part in a vehicle width direction with respect to a vehicle body center line extending in front and rear directions of the vehicle body.

11. The intake control device according to claim 1, wherein said sensor unit is attached to said air cleaner.

12. An intake control device controlling an intake amount of engine based on opening/closing of throttle valves in correspondence with an operation amount of an accelerator operating part, the intake control device comprising:

an air cleaner disposed above the engine and connected to the engine via the throttle valves;

a pair of right and left intake ducts projecting toward a front of a vehicle body from said air cleaner to take an outside air in said air cleaner; and a sensor unit coupled to a throttle cable extended from the accelerator operating part, and detecting the operation amount of the accelerator operating part, wherein said sensor unit is disposed, in said air cleaner, between openings of said pair of right and left intake ducts formed in said air cleaner, the sensor unit has an accelerator position sensor, a signal of the accelerator position sensor drives an electric motor opening/closing the throttle valves, the accelerator position sensor is provided between the intake ducts provided at a front half part of the air cleaner, and air funnels are provided at a rear half of the air cleaner.

13. The intake control device according to claim 12, wherein:

a filter is provided in said air cleaner to partition the inside of said air cleaner into a dirty side on an upstream side of an intake flow direction and a clean side on a downstream side of the intake flow direction; and said sensor unit is disposed on the dirty side.

14. The intake control device according to claim 12, wherein said sensor unit is disposed to overlap with a vehicle body center line extending in front and rear directions of the vehicle body, in a top view.

15. The intake control device according to claim 12, wherein:

a plurality of outside air intake ports through which an outside air is taken in the engine are provided in said air cleaner; and said sensor unit is disposed to overlap with a width center line passing through a center of width in a vehicle width direction of the plurality of outside air intake ports and extending in front and rear directions of the vehicle body, in a top view.

16. The intake control device according to claim 12, wherein:

said sensor unit has a throttle pulley that rotates in conjunction with the operation of the accelerator operating part via the throttle cable, and the accelerator position sensor that detects the operation amount of the accelerator operating part in correspondence with a rotation amount of the throttle pulley; and the throttle cable is extended forward from the throttle pulley.

17. The intake control device according to claim 12, wherein in said air cleaner, a pair of flow-regulating plates regulating an intake flow in said air cleaner are provided between said sensor unit and openings of said pair of right and left intake ducts.

18. The intake control device according to claim 12, wherein said sensor unit is disposed at a position higher than a lowest surface in said air cleaner.

* * * * *